US005221029A

United States Patent [19]

Stull

[11] Patent Number: 5,221,029

[45] Date of Patent: Jun. 22, 1993

[54] CLOSURE AND APPLICATOR CAP HAVING A BREAK-AWAY, FINGER-ENGAGEABLE TIP PORTION

[76] Inventor: Gene Stull, 1 Winston Farm La., Far Hills, N.J. 07931

[21] Appl. No.: 866,987

[22] Filed: Apr. 10, 1992

Related U.S. Application Data

[63] Continuation-in-part of Ser. No. 824,305, Jan. 23, 1992, abandoned.

[51] Int. Cl.[5] ..... B65D 47/10

[52] U.S. Cl. ..... 222/541; 222/568

[58] Field of Search ..... 222/420, 541, 568

[56] References Cited

U.S. PATENT DOCUMENTS

| | | | |
|---|---|---|---|
| 1,327,190 | 1/1920 | Bigoney | 222/541 |
| 3,124,280 | 3/1964 | Stull | 222/541 |
| 3,460,724 | 8/1969 | Chmella | 222/541 |
| 3,777,949 | 12/1973 | Chiquiari-Arias | 222/541 |
| 3,993,223 | 11/1976 | Welker, III et al. | 222/541 X |
| 4,248,227 | 2/1981 | Thomas | 222/541 X |
| 4,452,382 | 6/1984 | Von Holdt | 222/541 X |
| 4,566,613 | 1/1986 | Anscomb | 222/541 |
| 4,773,548 | 9/1988 | Deussen | 222/541 X |
| 5,040,706 | 8/1991 | Davis et al. | 222/541 |
| 5,121,856 | 6/1992 | Weiler et al. | 222/541 X |

*Primary Examiner*—Andres Kashnikow
*Assistant Examiner*—Kenneth Bomberg
*Attorney, Agent, or Firm*—H. Gibner Lehmann; K. Gibner Lehmann

[57] ABSTRACT

A closure and applicator cap adapted to be attached to the neck of a container which holds a flowable product. The cap includes a molded plastic cap body having a tip portion and an axially-extending discharge passage in the tip portion. The wall of the tip portion has an annular exterior cut extending completely around its circumference. The cut forms an annular zone of weakness in the wall of the tip portion. This zone of weakness is disposed in a first plane which is transverse to the axis of the tip portion, and which is offset downwardly of a second and higher plane containing the uppermost external annular edge of the cut. The tip portion has a flat extremity above the cut to enable it to be grasped and shifted so as to rupture the zone of weakness of the tip portion and expose the discharge passage thereof for the dispensing of product therethrough. Optionally, reinforcing struts are molded integral with the flattened extremity of the tip portion, to increase strength against inadvertent breakage.

11 Claims, 3 Drawing Sheets

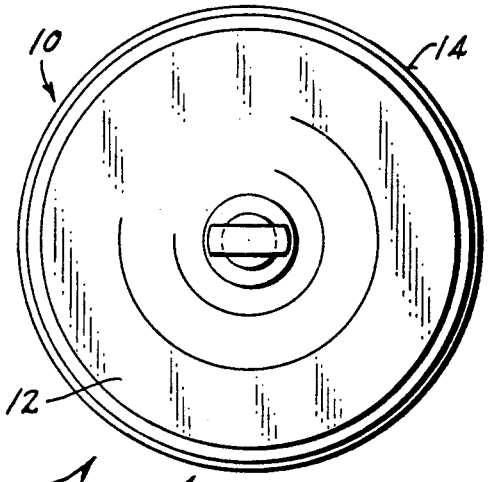
Fig. 1
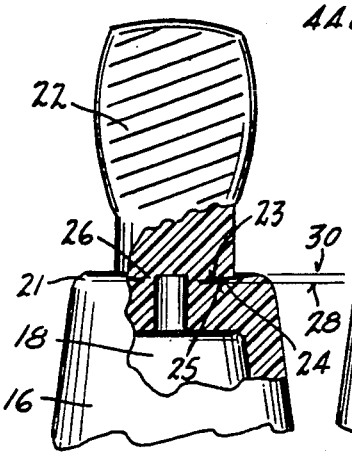
Fig. 3
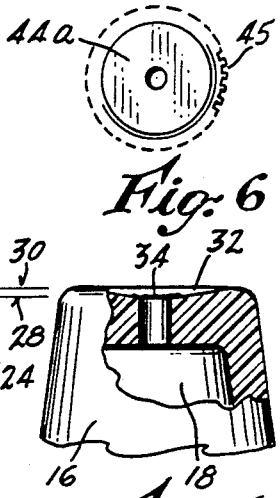
Fig. 6
Fig. 4
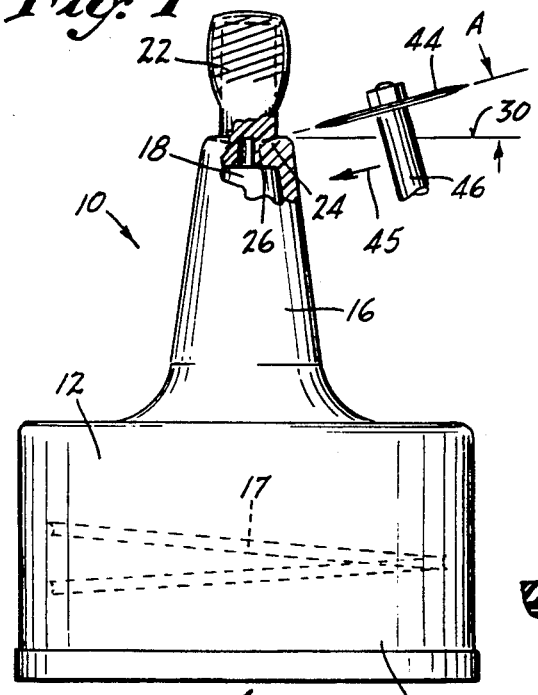
Fig. 2
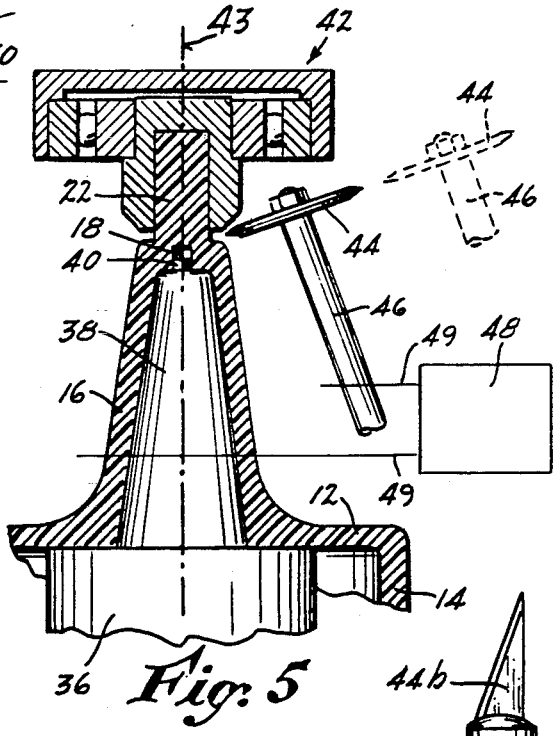
Fig. 5
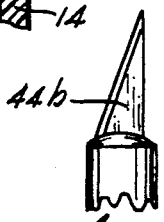
Fig. 7

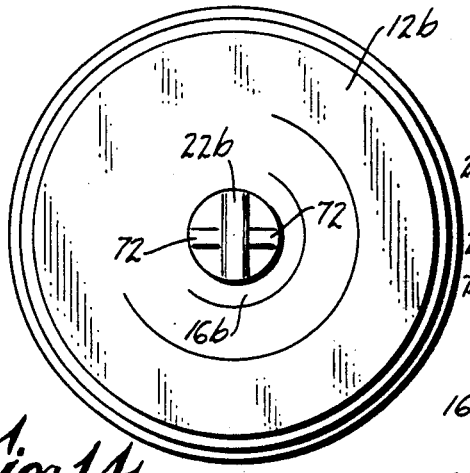
Fig: 14
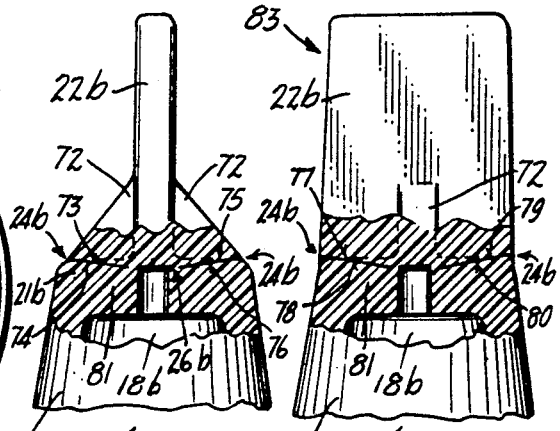
Fig: 17
Fig: 18
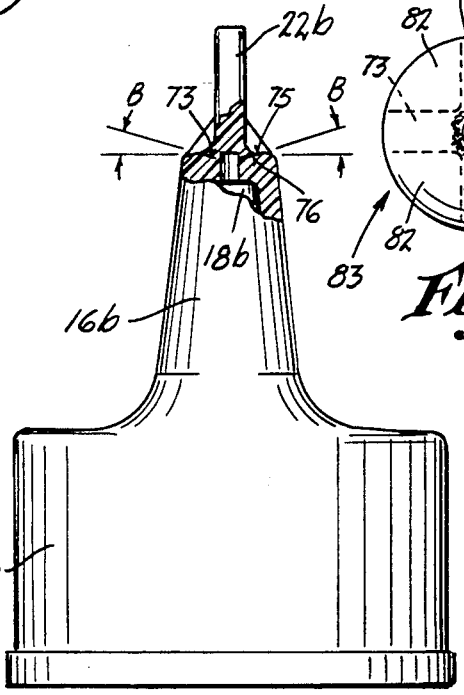
Fig. 15
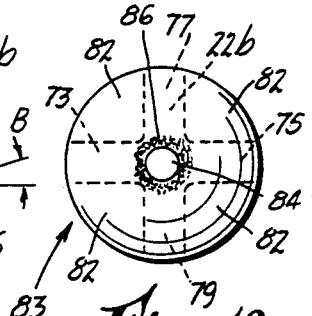
Fig: 19
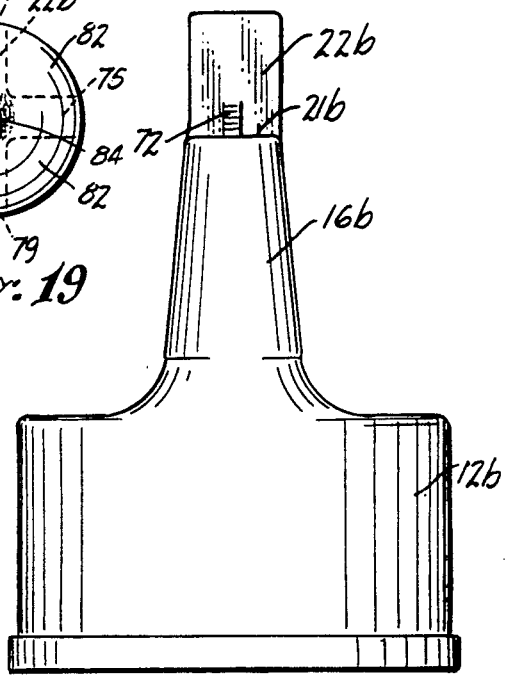
Fig. 16
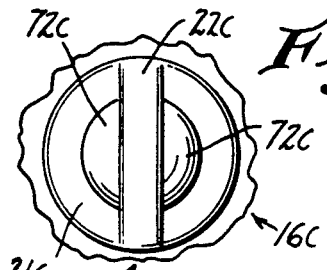
Fig: 20
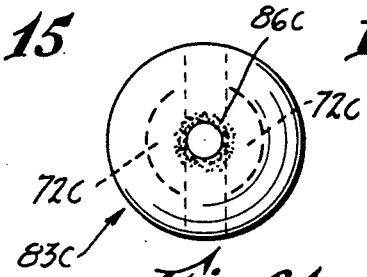
Fig: 21
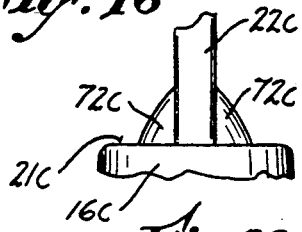
Fig: 22

CLOSURE AND APPLICATOR CAP HAVING A BREAK-AWAY, FINGER-ENGAGEABLE TIP PORTION

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

CROSS REFERENCES TO RELATED APPLICATIONS

The present application is a continuation-in-part of my copending application U.S. Ser. No. 07/824,305 filed Jan. 23, 1992, and entitled CLOSURE AND APPLICATOR CAP, abandoned.

BACKGROUND OF THE INVENTION

1. Field of the Invention

This invention relates to cap constructions for hand-held dispensers, and more particularly to dispensers of the type especially adapted to discharge controlled amounts of liquid over a predetermined area or line.

2. Description of the Related Art Including Information Disclosed Under 37 CFR §§1.97–1.99

In the past there has been proposed a number of dispenser caps having a reduced diameter tip portion the end of which was intended to be severed, as by cutting or snipping with a scissors, to expose a discharge orifice of small dimension, whereby the contents could be dispensed by inverting it and applying the tip to an area to be treated. In some designs, the user was instructed to squeeze the dispenser in order to effect the discharge.

A number of problems with such prior dispensers have arisen.

Where the dispenser was being used to apply a substance to the scalp of a user, the sharp point of the cut tip often scratched or punctured the skin, causing pain and irritation, and possibly infection.

Also the user had difficulty in determining the proper position and angle of the cut. With tapered tips, cutting at one location would produce an orifice which was too large, and thus led to problems with control and with excessive flow of the liquid solution. On the other hand, if the tip were cut nearer its end, the resulting orifice might be too small, again leading to difficulty in establishing a comfortable flow rate which would lend itself to controlled application of the liquid by the user.

In other arrangements, the cutting procedure itself could cause difficulty, since a knife, razor or scissors was usually needed, and if the instrument was not especially sharp, the plastic of which the cap was constituted tended to resist being severed cleanly, leaving burrs, tears, or causing warping of the resultant opening.

A prior plastic dispenser of the type having a manual break-away tip which was employed as an ampul, is illustrated and described in U.S. Pat. No. 4,926,915, issued to H. Deussen, and entitled "AMPUL". Since this device was not intended for application of liquid to the skin or scalp, the possible existence of sharp edges at the break-away opening was generally not a consideration. However, the possibility of inadvertent breaking or opening of the ampul existed if it was dropped or handled roughly, and this constituted a distinct disadvantage and drawback.

In other caps, where a break-away tip was molded integrally with the remainder of the cap, there was of necessity a requirement to hold the tolerances closely, so that preferably the inner and outer surfaces of the tip, after cutting, were generally concentric. This requirement was difficult to achieve in practice, particularly where the dimensions were small, and where the required mold tolerances might be as stringent as a few thousandths of an inch or less.

Generally, prior manually openable break-away caps have not found widespread use because of the likelihood of damage to the seal and inadvertent discharge of the container contents as a result of dropping or rough handling.

SUMMARY OF THE INVENTION

The above disadvantages and drawbacks of prior dispenser caps are obviated by the present invention which has for one object the provision of a novel and improved applicator cap construction which is both simple in its structure and which provides improved results from the standpoint of eliminating inadvertent irritation to the skin of the user, as from scratching or puncture-type wounds.

Still another object of the invention is to provide an improved cap construction in accordance with the foregoing, where less reliance on close mold tolerances is needed, to the end that manufacturing is simplified, and slight deterioration of the mold over time will not materially adversely affect the intended break-away capability of the tip of the cap.

Yet another object of the invention is to provide an improved cap construction as above set forth, wherein there is eliminated interference with smooth product discharge, such interference resulting from the existence of burrs or tears at the breakaway line or area of the tip.

A still further object of the invention is to provide an improved cap construction as above characterized, wherein the tip can be readily grasped by the user and easily manually torn or broken away in the intended manner, with no special tools such as a knife or scissors being required. A number of different surface configurations can be imparted to the portion of the tip intended to be grasped. In particular, a flattened shape with gripping ribs or serrations on its opposite faces has been found to be preferred. The flattening can be incorporated during molding of the cap, or alternately performed in a heat-stamping procedure as a secondary operation after the cap is molded.

Yet another object of the invention is to provide an improved cap construction of the kind indicated, which is resistant to inadvertent opening or breakage from being dropped during processing, thereby rendering the cap more reliable during manufacture, shipping, storage, and subsequent use.

Yet another object of the invention is to provide a novel and improved method of fabricating an applicator cap of the break away variety, which method is simple and can be carried out with minimal tooling and without the need for close tolerances in mold parts.

The above objects are accomplished by a closure and applicator cap adapted to be attached to the neck of a container which holds a flowable product, comprising a molded plastic cap body having a tip portion and an axially-extending discharge bore or passage in the tip portion and where the wall of the tip portion has an annular exterior cut extending completely around its circumference. The cut forms an annular line or zone of weakness in the inner wall of the tip portion. This zone of weakness is disposed in a plane which is transverse to the axis of the tip portion, such plane being offset downwardly from a second plane that contains the uppermost external annular edge of the cut. The tip portion has a flat extremity above the cut to enable it to be grasped and bent or twisted so as to rupture the line of weakness of the tip portion and expose the discharge passage thereof for the dispensing of product therethrough.

In accomplishing the method of the invention, there are provided the steps of molding a cap body comprising an upstanding hollow spout having a break-off closure tip which seals the spout, placing the molded cap on a mandrel, rotating the mandrel and cap, and making a circular cut partially through the spout adjacent the break-off tip as the cap is turning, thereby to produce an annular line or zone of weakness in the spout wall so as to facilitate manual breaking off of the tip. The cut zone of weakness has the advantage that predictable break away characteristics are obtainable, which have been found to yield results that are superior to molded zone-of-weakness counterparts of prior design.

Other features and advantages will hereinafter appear.

BRIEF DESCRIPTION OF THE DRAWINGS

In the drawings, illustrating several embodiments of the invention:

FIG. 1 is a top plan view of the improved dispensing and applicator cap of the invention.

FIG. 2 is a side elevational view, partly in vertical section, particularly showing the application of a circular cutting blade to the exterior surface of the tip portion, to form an external cut or slit that leaves an internal wall constituting a line or zone of weakness to enable the extremity of the tip portion to be manually broken off just prior to use.

FIG. 3 is a fragmentary view, partly in elevation and partly in vertical section, particularly showing the tip portion of the cap following cutting by the blade of FIG. 2.

FIG. 4 is a view like FIG. 3, except showing the cap after the extremity of its tip portion has been manually broken away.

FIG. 5 is an axial section, showing a rotary cutter for use in imparting a transverse cut or slit to the tip of the cap.

FIG. 6 is a plan or end view of an alternate rotary cutting blade, for imparting a modified slit configuration to the exterior of the tip of the cap.

FIG. 7 is a fragmentary side elevation of an alternate cutting blade in the form of a simple knife, for performing the slitting operation on the tip portion of the cap.

FIG. 14 is a top plan view of a modified, reinforced dispensing and applicator cap, having a pair of struts disposed on opposite sides of the flat extremity of the tip portion, and having cuts, forming pairs of opposed abutting blocking surfaces, to thereby minimize inadvertent break off the flat extremity of the tip portion during handling.

FIG. 15 is a front elevational view of the cap of FIG. 14.

FIG. 16 is a side elevational view of the cap of FIGS. 14 and 15.

FIG. 17 is a fragmentary view, enlarged and in part section, part elevation, of the cap of FIGS. 14–16.

FIG. 18 is a fragmentary view, enlarged and in part section, part elevation, of the cap of FIGS. 14–17, taken at 90° with respect to the view of FIG. 17.

FIG. 19 is a bottom plan view of the upper part of the tip portion of FIGS. 17 and 18 after it has been broken off, and the cap is ready for use.

FIG. 20 is a fragmentary top plan view of the tip portion of a further modified cap where the tip portion has a pair of fillets disposed on opposite sides of its flat extremity, constituting yet another embodiment of the invention.

FIG. 21 is a bottom plan view of the upper part of the tip portion of FIG. 20 after it has been broken off, and the cap is ready for use, and FIG. 22 is a fragmentary side elevation of the tip portion of FIGS. 20 and 21, prior to break away.

DESCRIPTION OF THE PREFERRED EMBODIMENTS

Figure 8:
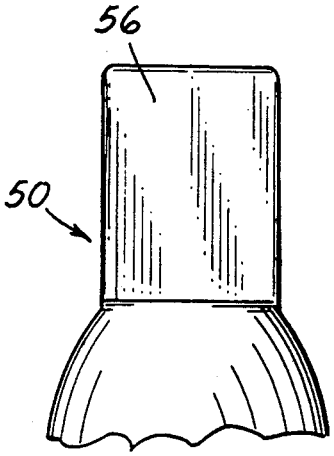
FIG. 8 is a fragmentary side elevation of a modified cap, showing one possible tip configuration, characterized by a rectangular outline.

Referring first to FIGS. 1–3 there is illustrated a molded plastic closure and applicator cap 10 adapted to be secured on the neck of a container (not shown) and comprising a cap body 12 having an annular skirt 14 and having a tip or spout portion 16 with an axially extending discharge passage 18 therein. The skirt 14 has suitable means such as internal screw threads 17 or a retention bead (not shown), for securement to the container neck.

In accordance with the present invention the tip portion 16 of the cap body 12 has an extremity 22, preferably flat, which can be grasped by the fingers of a user, and the wall of the tip portion 16 has an annular exterior cut 24 extending completely around its circumference so as to form an annular line or zone of weakness or annular bridge of material 26 at the inner surface of the tip portion. The zone of weakness 26 is disposed in a plane 28 (FIG. 3) which is transverse to the axis of the tip portion 16, such plane 28 being offset downwardly from a higher plane 30 that contains the uppermost external annular or peripheral edge of the cut 24. The tip portion 16 has a shoulder 21, and in accordance with the present invention, the cut forms two pairs of deformation-resistant or solidly backed-up abuttable blocking surfaces, one such pair being designated 23, 25 in FIG. 3, and the surfaces of each pair being engageable with one another. The blocking surfaces 23 are on the underside of the extremity, whereas the blocking surfaces 25 are on the shoulder 21. The engagement of these blocking surfaces functions to strengthen and stiffen the flat extremity 22 of the tip portion on the shoulder 21, and minimize the possibility of the extremity 22 being inadvertently broken in the event the dispenser is dropped and with the tip portion 16 facing downward. However, the arrangement is such that just prior to use by the consumer, the extremity 22 of the tip portion 16 can be readily grasped by the user and torn, broken or twisted off the remainder of the tip portion, to thereby expose the discharge passage 18 and permit the contents of the container to be dispensed therethrough. In the embodiment of FIGS. 1-3, the cut is angled with respect to the plane 30, so as to form a generally conical recess 32, FIG. 4, in the upper surface of the broken tip. This figure also shows remnants of the severed portions or tears in the form of burrs 34 at the location of the original annular line of weakness or bridge 26.

Referring to FIGS. 2 and 5, the cut 24 in the wall of the tip portion 16 is made following molding of the cap. FIG. 5 illustrates a jig for performing the cut, comprising a mandrel or arbor 36 turnably supported on suitable bearings (not shown), and having the cap body 12 positioned thereon. Preferably the mandrel 36 has a conical tip 38 and a protrusion 40 which fits into the small diameter discharge passage or bore 18.

In FIG. 5, the flat extremity 22 of the tip portion 16 is suitably supported in a ball bearing assembly 42, such that the cap body 12 can be turnably power driven about an axis that is concentric with respect to its axis of symmetry 43.

Preferably a circular knife or blade 44 carried on a shaft 46 is advanced on the turning cap 10 as indicated by the arrow 45, and depending on the nature of the plastic, the blade 44 can be driven in synchronism with the mandrel 36 or at a somewhat different speed in order to achieve a clean cut. The blade 44 is movable with its shaft in an angular direction at an angle A in FIG. 2 transverse to the cap or shaft axis, as shown, from a position illustrated in dotted outline in FIG. 5 to the position in solid outline and beyond, so as to engage and cut the tip wall. An electromechanical drive mechanism generally designated 48, controls and/or synchronizes the movements of both the mandrel 36 and the blade 44. Lines 49 diagrammatically depict a mechanical drive connection between the mandrel 36 and shaft 46.

FIG. 3 shows the cap following the cut. The exterior of the tip wall has been cut through not quite completely, leaving the annular bridge 26 at the inner periphery of the cut 24, the bridge 26 constituting the annular line or area of weakness which is to be ruptured when the user grasps the extremity 22 of the tip portion and pulls or twists the extremity. Depending on the resilience of the plastic, the walls of the cut 24 in FIG. 3 essentially overlap and contact one another. The resulting tip appears as in FIG. 4, which illustrates the upper surface of the tip as comprising the generally conical surface 32 characterized by the central discharge passage 18 and having the burrs 34 at the location of the originally formed annular bridge 26.

The construction illustrated in FIGS. 3 and 4 has the distinct advantage that the area of tearing, adjacent the burrs 34, is slightly recessed axially below the outer peripheral edge of the tip portion. This outer peripheral edge, which is formed during the molding, can be made especially smooth and free of any sharp or rough surfaces. In the event that the tip portion is to be employed to dispense liquid substance to the skin or scalp, the absence of rough or sharp surfaces at this peripheral edge is considered important so as to eliminate any possibility of scratching of the skin/scalp, and resultant irritation thereto. By the invention, the only area which is prone to burrs is that indicated by the numeral 34, and as noted above, this area is recessed axially (downwardly) with respect to the peripheral edge, thereby avoiding its contact with the skin/scalp.

In the case of a cap construction of the break away tip variety, there are a number of advantages to employing a cut wall as opposed to a molded wall with an integrally formed line of weakness. In particular, with small cap sizes, the various close tolerances to which the mold parts must be held often renders the molding process impractical. Eccentricities of either of the mold parts inevitably lead to corresponding nonuniform wall thicknesses at the intended areas of weakness. The desired break-away characteristics are difficult to predict, and also difficult to control on a repeatable basis. In addition, with molded parts, in the event that the container is inadvertently dropped and lands on its tip portion, there is a distinct possibility of the extremity, such as at 22, of the tip portion snapping and breaking, resulting in loss of the container and its contents. Many products marketed today are subjected to "drop testing", and under such circumstances the possibility of inadvertent breakage of the tip portion of the cap thus becomes an important consideration.

In contrast, with a cut as provided by the cap of the invention, the impact of a drop test force on the extremity 22 can be largely transmitted directly to the remainder of the tip below the cut 24 by the solidly-backed abuttable blocking surfaces 23, 25, since the cut can be made in the form of a slit, where essentially no material is removed; instead a minute separation of the material occurs. With suitable resilience of the plastic, the walls of the cut 24 can effectively be substantially in engagement with one another, which causes "drop test" forces applied to the extremity of the tip portion to be mostly of a nondestructive nature.

Also, by employing a cut with a mandrel and knife as shown, the cut itself can be controlled to be precisely concentric with the axis of the cap, even if the cap body wall has a slight eccentricity, either in its outer or inner surface. This is a consequence of the precision with which the mandrel and cutter blade shaft can be positioned and held with respect to one another. It has been determined that the precision obtainable with a cut leads to break-away characteristics which can be predicted to a greater degree of certainty than in the case of molded counterparts; problems with non-uniformity and poor repeatability from unit to unit are also greatly minimized.

Figure 13:
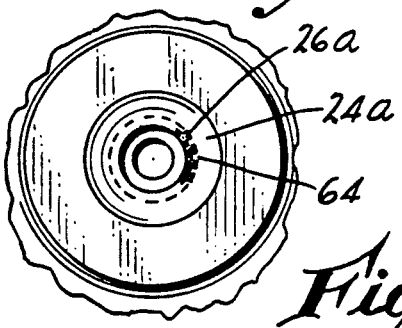
FIG. 13 is a top plan view of the cap of FIG. 12, showing both the constriction in the discharge bore, and also illustrating a series of serrations as would be produced by a toothed or crenelated cutting wheel such as that of FIG. 6.

An alternate blade configuration is illustrated in FIG. 6, showing a circular cutting blade **44*a* with external sharpened teeth designated 45. This blade 44*a* can be substituted for the blade 44 in the jig of FIGS. 2 and 5, for imparting a stepped circumferential cut to the wall of the tip portion. Such a construction is shown in FIG. 13. Under these circumstances, the toothed blade 44a would be turned, via the drive mechanism 48, at a speed to correspond to that of the mandrel 36. The depth of the cut would be designed to provide the desired tear or break-away strength for the extremity 22 of the tip portion. In other respects, the cutting operation would be similar to that of FIG. 5**.

A modified, flat blade 44b is illustrated in FIG. 7, which could be substituted for the circular blade 44 of FIGS. 2 and 5. The blade 44b of FIG. 7 does not rotate, however, but instead is merely movable transversely of the axis of the cap in directions along the solid outline and dotted outline positions of the circular blade shown in FIG. 5. The mandrel 36 would be turnably driven as before. Depending on the nature of the plastic of which the cap is constituted, it is considered that use of a blade 44b similar to that of FIG. 7 would produce acceptable results for many applications.

Figure 9:
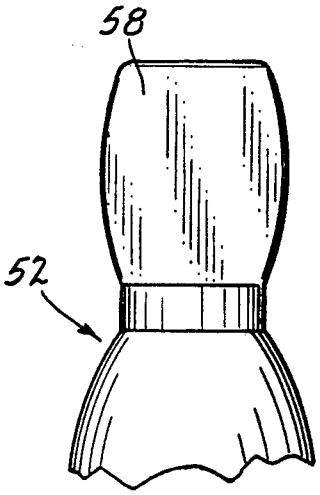
FIG. 9 is a fragmentary side elevation of a further modified cap showing still another tip configuration, namely one having a bulbous rectangular outline.
Figure 10:
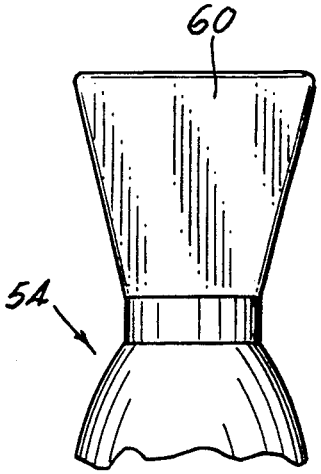
FIG. 10 is a fragmentary side elevation of a still further modified cap showing yet another tip configuration, namely one having a trapezoidal outline.

Alternate configurations for the extremity of the tip portion of the cap are illustrated in FIGS. 8–10, respectively, with the caps being designated 50, 52 and 54. FIG. 8 shows an extremity 56 having a generally rectangular outline or profile, whereas FIG. 9 illustrates a modified rectangular outline 58, characterized by bulging sides. FIG. 10 shows a trapezoidal outline 60. The particular application for which the cap was intended would dictate which shape would be most appropriate. Preferably, a non-smooth surface configuration is imparted to these extremities 56–60, such as ribbing, dimpling, or the like, to facilitate grasping by the user.

Figure 11:
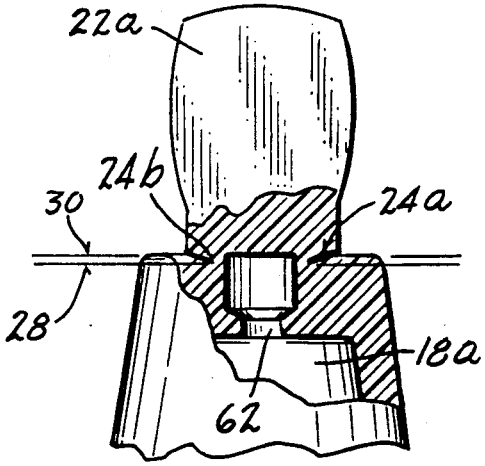
FIG. 11 is a side elevational view, partly in axial section, of a modified cap, having in addition to an external slit, a discharge bore characterized by an internal flow-profiling constriction which reduces any tendency for the product flow to be adversely influenced by the existence of burrs or tears at the break away line of the tip portion of the cap.
Figure 12:
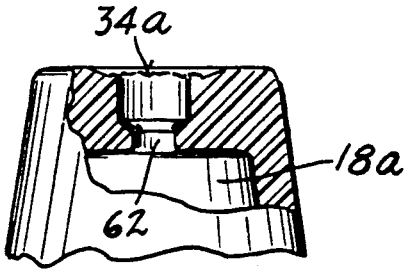
FIG. 12 is a view of the cap of FIG. 11 after the extremity of the tip portion has been broken away and the cap is ready for use. This figure particularly illustrates the central alignment of the constriction of the discharge bore with respect to the peripheral burrs that have resulted from the break away operation.

Yet another embodiment of the invention is illustrated in FIGS. 11–13, wherein like reference numerals with the suffix "a" designate parts corresponding to those of the previous embodiments. There is provided, in combination with an annular exterior cut 24a forming an annular zone of weakness of crenelated section, a well-defined annular rib or constriction 62 in the bore or discharge passage 18a. The cut forms severed surface portions which are preferably in engagement with one another. The innermost annular boundary of the cut is designated in FIG. 11 by the numeral 24b. As seen in FIG. 12, following removal of the extremity 22a, there usually remain one or more burrs 34a, and the constriction 62 operates as a directional flow control for the product being dispensed. As a consequence, the product tends to remain centralized with respect to the peripheral area containing the burrs 34a with the result that the burrs 34a do not materially deflect the otherwise smooth axially-directed flow from the passage 18a. This is in sharp constrast to prior devices where there did exist a possibility of interference with flow by a burr or a series of burrs. FIG. 13 illustrates a cut 24a made with the blade 44a of FIG. 6, with perforations 64 assisting in proper break away characteristics for the extremity 22a.

The cap and applicator of FIGS. 11–13 is thus especially well suited for applying to the scalp a lotion or cream in the form of an uninterrupted stream along a specific line or path.

In other respects the construction illustrated in FIGS. 11–13 is similar to that of FIGS. 1–4.

Still another embodiment of the invention is illustrated in FIGS. 14–19, wherein like reference numerals with the suffix "b" designate parts corresponding to those of the previous embodiments. The cap body 12b has a tip portion 16b with an axially extending discharge passage 18b. By the present invention the tip portion 16b has a flat extremity 22b comprising integrally formed reinforcing means in the form of oppositely-disposed side edge portions of the extremity 22b, and a pair of substantially triangular struts 72 disposed on opposite sides of the extremity 22b and extending between the same and the annular shoulder 21b of the tip portion 16b of the cap. An annular exterior cut 24b extends completely around the circumference of the tip portion 16b, disposed at an angle B (FIG. 15) with respect to a plane perpendicular to the cap axis, to thus form four pairs of backed-up (reinforced) abuttable blocking surfaces 73, 74; 75, 76; 77, 78; and 79, 80, shown in FIGS. 17 and 18 as engaged with each other. The blocking surfaces 73, 75, 77 and 79 are connected by webs 82 in FIG. 19, following the cutting, these being readily perceived after break away of the tip portion extremity 22b. In this FIG. 19 the entire surface that is shown comprises essentially a shallow cone, consisting of four thin, pie-shaped web portions 82, four substantially rectangular solidly-backed portions 73, 75, 77 and 79, a small circular center portion 84 and a somewhat ragged ring-shaped torn-away portion 86. All of the portions 73, 75, 77, 79 and 82 abut the oppositely disposed mating surface portions 74, 76, 78 and 80 and pie-shaped intermediary surfaces (not numbered) of the tip portion that remain after the break-off. These blocking surfaces have the desired effect of transmitting lateral forces applied against the flattened extremity 22b to the remaining bridge 26b in an axially upward or downward direction. This effect arises because forces applied to the flattened extremity 22b are opposed by the engagement of one or more of the pairs of blocking surfaces noted above. As a consequence, there is little likelihood of the extremity 22b inadvertently breaking from a sideways or lateral blow, or a direct axial blow, as might occur if the container were to be inadvertently dropped.

Because the cut extends a substantial distance radially inwardly from the outer surface of the tip portion 16b, however, the inclusion of the struts 72 does not adversely affect the ability of the user to tear the flattened extremity 22b just prior to use of the dispenser, especially if a twisting force is applied. Improved reliability and resistance to inadvertent opening of the cap are thus realizeable with the incorporation of these struts 72. They are preferably initially molded integrally with the remainder of the tip portion.

The construction of FIGS. 14–19 can be considered in somewhat modified terms. Specifically, the tip portion 16b has a transverse top wall 81 which contains the reduced diameter part of the discharge passage 18b, and which top wall has a generally concave upper surface portion comprising surfaces 74, 76, 78 and 80. Similarly, the broken off component illustrated in FIG. 19 can be considered to be a stopper member 83, and to include the extremity 22b, a base with lower surfaces 73, 75, 77 and 79, the webs 82, and the struts 72. In the closed position of the closure and applicator cap construction, the stopper member occupies the position shown in FIGS. 17 and 18, wherein the lower surfaces 73, 75, 77 and 79 are received in the concave configuration made up of surfaces 74, 76, 78 and 80 and the pie-shaped intermediary surfaces that connect them. The zone of weakness represented by the bridge 26b is integral with both the stopper member and with the transverse top wall, and is formed as a residual annular island surrounding the discharge passage when the cut 24b is made. The bridge 26b and stopper member 83 normally close off the discharge passage to seal the same against leakage. The bridge 26b is frangible and capable of being ruptured in response to force (preferably a twisting force) applied to the stopper member, after which the stopper member can be removed from the transverse top wall to thus expose the discharge passage 18*b*.

In other respects the construction of FIGS. 14–16 is similar to those of the previous embodiments.

Still another embodiment of the invention is shown in FIGS. 20–22, wherein like reference numerals having the suffix "c" designate components similar to those of the previous embodiments. By the invention the extremity 22*c* of the tip portion 16*c* in FIG. 20 has a width that is substantially equal to the diameter of the shoulder 21*c*, and there are disposed on opposite sides of the flat extremity 22*c* a pair of fillets 72*c*, shown as having a bulbous or convex surface configuration. The fillets 72*c* are molded integrally with the extremity 22*c* and with the shoulder 21*c*. They add stiffening to the extremity 22*c* in a manner similar to the struts 72 of the embodiment of FIGS. 14–19. FIG. 21 is a bottom plan view of the upper part of the tip portion 16*c*, hereinafter also referred to as a stopper member 83*c*, after it has been torn away or severed from the remainder of the tip portion 16*c*. The portion 86*c* has burrs which resulted from the tearing operation. As in the previous embodiments the area in which these burrs is located lies axially below the periphery of the shoulder 21*c*, so that when the latter is touched to the skin/scalp, the burrs at portion 86*c* do not come into contact therewith. Instead, the relatively smooth peripheral part of the shoulder 21*c* is the part which contacts the skin/scalp. In FIG. 21 the fillets 72*c* are shown in dotted outline. FIG. 22 shows the fillets 72*c* as viewed from one side of FIG. 20.

Referring again to FIGS. 2 and 5 and in accordance with the present invention there is provided a novel method for making an applicator cap 10 of a type having a break away spout or tip portion 16, comprising the steps of molding the cap body and upstanding hollow spout 16 having a break-off extremity 22 which seals the spout 16, placing the molded cap body 12 on a mandrel 36, rotating the mandrel 36 and cap body 12, and making a circular cut 24 partially through the spout wall adjacent the break-off extremity 22 as the cap body is turning, so as to produce an annular line or zone of weakness or bridge 26 in the spout wall and thereby facilitate manual breaking off of the extremity 22 During the cutting operation, preferably the inside of the spout is supported by the mandrel 36 at a location near the cut.

In effecting the cut, there can be provided a rotating sharp circular cutter or blade 44 or 44*a* that is moved transversely against and into the surface of the spout wall. The cutter or blade can be either circular, as in FIGS. 2 and 5, or notched, as in FIG. 6. As an alternative, the cutter can be in the form of a knife 44*b*, FIG. 7, which is moved transversely toward the spout wall and applied thereto in order to effect the cut. As noted above, in the case of circular cutters, the speed of turning is synchronized to that of the mandrel in order to reduce tearing or binding between the cutter and cap. Following the cut, the knife 44, 44*a*, or 44*b* is withdrawn and the cap removed from the mandrel.

From the above it can be seen that I have provided novel and improved dispensing and applicator caps which are both extremely simple in their structure, and rugged and reliable in use. The provision of a slitted tip wall facilitates manufacture by insuring accuracy in the location of the cut and the location of the remaining bridge which constitutes the annular zone of weakness. There is significantly enhanced resistance to inadvertent breakage of the tip portion as a result of dropping, without sacrifice of ease of use by the consumer. The disclosed devices are thus seen to represent distinct advances and improvements in the field of hand-held applicator type dispensers.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A closure and applicator cap adapted to be attached to a neck of a container which holds a flowable product, comprising, in combination:

a) a cap body of molded plastic substance, having means for securing it to the container neck, b) said cap body having a tip portion comprising a tubular wall, said tip portion having an axis, said cap body having an axially-extending discharge passage in said tip portion, c) the wall of said tip portion having severed portions defining an annular exterior dished cut with an uppermost external annular edge extending completely around its circumference, d) said cut effecting an annular zone of weakness in said wall of the tip portion, e) said zone of weakness being disposed in a plane which is transverse to the axis of the tip portion and which is offset downwardly of another plane containing the uppermost external annular edge of said cut, f) said tip portion having a flat extremity located above said cut to enable it to be grasped and bent so as to rupture the zone of weakness of the tip portion and expose the discharge passage thereof for the dispensing of product therethrough.

2. The closure and applicator cap as set forth in claim 1, wherein said flat extremity has non-slip surface configurations which are to be grasped by the fingers of a user.

3. The closure and applicator cap as set forth in claim 1, wherein the dished cut has a conical configuration.

4. The closure and applicator cap as set forth in claim 1, wherein the dished cut has an innermost annular boundary and the dished cut comprises said severed portions.

5. The closure and applicator cap as set forth in claim 1, wherein the zone of weakness comprises a crenelated section.

6. The closure and applicator cap as set forth in claim 1, wherein:

a) said zone of weakness is characterized by burrs after said tip portion is bent and the zone of weakness is ruptured, and b) means in the discharge passage of the tip portion, defining a constriction to regulate and guide flow of said product past said burrs, such that the burrs do not materially alter the rate of said flow.

7. A closure and applicator cap adapted to be attached to a neck of a container which holds a flowable product, comprising, in combination:

a) a cap body of molded plastic substance, having means for securement to the container neck, b) said cap body having a tip portion comprising a tubular wall, said tip portion having an axis, said cap body having an axially-extending discharge passage in said tip portion, c) the wall of said tip portion having an annular exterior dished cut with an uppermost external annular edge extending completely around its circumference, d) said cut effecting an annular zone of weakness in the wall of the tip portion, e) said zone of weakness being disposed in a plane which is transverse to the axis of the tip portion and which is offset downwardly of another plane containing the uppermost external annular edge of said cut, f) said tip portion having a flat extremity located above said cut to enable it to be grasped and shifted so as to rupture the zone of weakness of the tip portion and expose the discharge passage thereof for the dispensing of product therethrough, and g) reinforcing means on said tip portion comprising cooperable abuttable blocking surfaces for yieldably blocking said flat extremity against lateral movement, thereby to minimize the likelihood of inadvertent premature break off of the flat extremity of the tip portion at the said zone of weakness thereof.

8. The closure and applicator cap as set forth in claim 7, wherein:

a) said tip portion has a shallow cone adjacent the flat extremity thereof, b) said reinforcing means comprising a strut extending between said flat extremity and shallow cone.

9. The closure and applicator cap as set forth in claim 7, wherein:

a) said tip portion has a shallow cone adjacent the flat extremity thereof, b) said reinforcing means comprising a pair of struts disposed on opposite sides of said flat extremity and extending between the latter and the shallow cone of the tip portion of the cap.

10. The closure and applicator cap as set forth in claim 8, wherein:

a) the shallow cone of the tip portion is annular and extends circumferentially around the tip portion, b) said strut being of triangular configuration and having one of its edges extending radially at said shallow cone.

11. A closure and applicator cap adapted to be attached to a neck of a container which holds a flowable product, comprising, in combination:

a) a cap body of molded plastic substance, having means for securement to the container neck, b) said cap body having a tip portion comprising a tubular wall, said tip portion having an axis, said cap body having an axially-extending discharge passage in said tip portion, c) the wall of said tip portion having an annular exterior cut with an uppermost external annular edge extending completely around its circumference, d) said cut effecting an annular zone of weakness in said wall of the tip portion, e) said zone of weakness being disposed in a plane which is transverse to the axis of the tip portion and which is offset downwardly of another plane containing the uppermost external annular edge of said cut, f) said tip portion having a flat extremity located above said cut to enable it to be grasped and bent so as to rupture the zone of weakness of the tip portion and expose the discharge passage thereof for the dispensing of product therethrough, and g) reinforcing means on said tip portion comprising cooperable abuttable blocking surfaces for yieldably blocking said flat extremity against lateral movement, thereby to minimize the likelihood of inadvertent premature break off of the flat extremity of the tip portion at the said zone of weakness thereof, h) said tip portion having a shallow cone adjacent the flat extremity thereof, i) said reinforcing means comprising a strut extending between said flat extremity and shallow cone, j) the shallow cone of the tip portion being annular and extending circumferentially around the tip portion, k) said strut being of triangular configuration and having one of its edges extending radially at said shallow cone, l) another edge of the strut extending axially of the tip portion and along the said flat extremity.

* * * * *